US005269413A

United States Patent [19]

Stern

[11] Patent Number: 5,269,413

[45] Date of Patent: Dec. 14, 1993

[54] CONTAINER FOR PILLS

[76] Inventor: George Stern, 4 Cromwell Dr. West, Morristown, N.J. 07960

[21] Appl. No.: 941,256

[22] Filed: Sep. 4, 1992

[51] Int. Cl.[5] ..... B65D 83/04

[52] U.S. Cl. ..... 206/535; 206/37; 206/811; 215/231; 215/DIG. 3

[58] Field of Search ..... 206/528, 534, 535, 536, 206/537, 538, 37, 38, 811; 215/231, 354, 356, 358, 341, 364, DIG. 3

[56] References Cited

U.S. PATENT DOCUMENTS

| | | | |
|---|---|---|---|
| 567,488 | 9/1896 | Moehn | 206/535 X |
| 1,671,285 | 5/1928 | Hanna | 206/535 X |
| 2,060,406 | 11/1936 | Tiede | 206/537 |
| 2,294,001 | 8/1942 | Ritter | 206/537 |
| 3,306,493 | 2/1967 | Szajna | 206/536 X |
| 3,365,099 | 1/1968 | McTaggart | 206/535 X |
| 3,612,348 | 10/1971 | Thomas | 206/535 X |
| 4,129,228 | 12/1978 | Stoneback | 215/329 X |
| 4,166,537 | 9/1979 | Fortunato | 206/535 |
| 4,174,048 | 11/1979 | Volpe, Jr. | 206/537 X |
| 4,402,420 | 9/1983 | Chernack | 220/266 |
| 4,420,076 | 12/1983 | Beveridge et al. | 215/364 X |
| 4,589,575 | 5/1986 | Rigberg et al. | 206/535 X |
| 4,756,407 | 7/1988 | Larsen | 215/364 X |
| 5,018,621 | 5/1991 | O'Connell, Jr. | 206/535 X |

*Primary Examiner*—David T. Fidei
*Assistant Examiner*—Jacob K. Ackun, Jr.
*Attorney, Agent, or Firm*—Thomas L. Adams

[57] ABSTRACT

A pill container has a casing with a closed end, an open end, and a chamber. The chamber can hold the pills and communicate with the open end. A cap having an inside surface can releasably attach to the open end and close the casing. A pin is centrally secured at the inside surface of the cap. This pin is positioned to extend into the chamber of the casing when the cap is attached to the casing. A plunger is slidably mounted in the chamber of the casing. A spring mounted in the casing can urge the plunger toward the open end of the casing to hold the pills in position, so that agitation would not tend to powder the pills.

15 Claims, 2 Drawing Sheets

FIG. 1
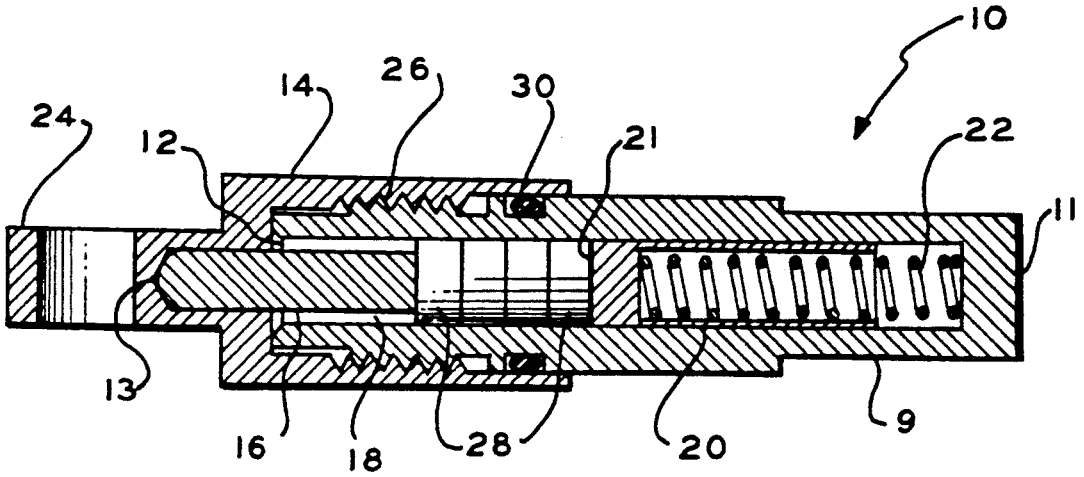
FIG. 2
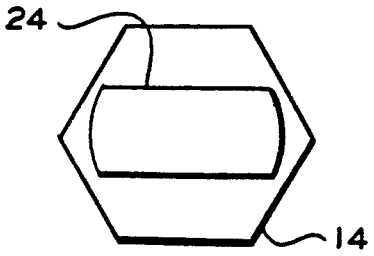
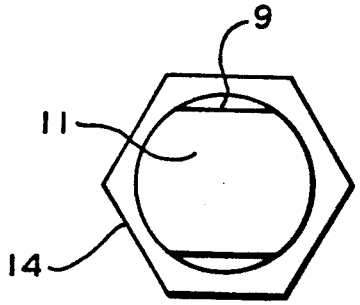
FIG. 3

CONTAINER FOR PILLS

BACKGROUND OF THE INVENTION

The present invention relates to a container for holding pills, and in particular to a container that can be worn or carried by a person who may need quick and easy access to the pills which should not powder when the container is moved or deteriorate when the container is exposed to light and moisture.

Persons with certain heart conditions may without warning need to immediately take a nitroglycerin tablet. In an emergency and in pain, the user may have difficulty locating a pill bottle. For this reason, a pill container may be worn or carried by the person at all times. Since the user may carry the pills in the shower or when swimming, the pill container should be watertight. Moreover, medicines such as nitroglycerin tend to lose their potency and should be preserved in a tightly sealed container.

Also, pill containers are handled in unpredictable ways that can cause the pills to collide and break apart or even grind themselves into a powder. Therefore, steps should be taken to prevent disintegration.

U.S. Pat. No. 4,171,753 shows a pill dispenser having a spring loaded inner pill cartridge inside a tubular outer housing. A dispensing lid is threaded atop the outer tube. Reloading this holder is difficult as the pills must be inserted through the bottom of the pill cartridge and pushed upward. Moreover, the pills tend to pop out of the inner tube as the spring pushes the pills upward toward the dispensing opening. This pill holder lacks an accessory to allow it to be worn by the user. Therefore, one would have to search for the holder in an emergency. Additionally, a watertight seal is not disclosed between the dispensing lid and the outer tube.

U.S. Pat. Nos. 1,671,285; 4,295,579; and 4,589,575 show spring loaded pill dispensers. Atop these dispensers is a cap which either swings or is removable to dispense pills. Again, these devices lack an accessory to allow wearing by the user and are difficult to load. Another disadvantage with these dispensers is the tendency of the spring mechanism to allow unwanted pills to pop out. Additionally, the caps on top of the dispensers apparently do not form a watertight seal.

In U.S. Pat. No. 4,129,228 a pill container consists of two threaded pieces. An eyelet on one piece allows the container to be worn around the user's neck. The pills are free to move and are prone to colliding and breaking.

U.S. Pat. No. 2,294,001 shows a tablet dispenser with a pocket clip, having a threaded plunger rotatably mounted on a coupling. The plunger dispenses a tablet when the coupling is rotated. Reloading this dispenser is time consuming as the plunger must be retracted by rotating the coupling in the opposite direction. Because of the loose fit of the pills, the pills may rattle, cock and break apart during transportation. Also, there is no disclosure of a watertight seal around the dispenser.

U.S. Pat. Nos. 2,935,180 and 3,612,348 both disclose tablet dispensers employing a ratcheting mechanism. These devices lack an accessory to allow it to be worn by the user. In addition, both of these dispensers are difficult to reload as they are not easily opened.

U.S. Pat. No. 567,488 shows a vial containing a stack of tablets overlaid with a spring and sealed with a cork. This device is difficult to manage as the spring is attached to the cork and fully extends when removed from the vial. Additionally, the vial lacks an accessory to permit it to be worn by the user.

U.S. Pat. Nos. 4,420,076 and 4,756,407 show pill containers closed by a plug or cap having an eyelet. However, the pills can rattle since there is no mechanism to secure them inside the container. See also U.S. Pat. Nos. 3,095,085; 3,306,493; 3,762,539; and 4,166,537.

Accordingly, there is a need for a simple pill container that is easy to reload, forms a tight seal when closed, prevents the pills from rattling together, and can be worn by a person who may need quick and easy access to the pills.

SUMMARY OF THE INVENTION

The present invention relates to a pill container, and in particular to a container that can be worn by a person who may need quick and easy access to the pills contained inside.

It is an object of this invention to provide a pill container that secures the pills in place to prevent damage.

It is a further object of this invention to provide a pill container that forms a tight seal.

It is yet a further object of this invention to provide a pill container that can be worn or carried by a person.

An additional object is to provide a pill container that is reliable and efficient.

In accordance with the illustrative embodiments demonstrating features and advantages of the present invention, there is provided a container for pills having a casing and a cap. The casing has a closed end, an open end and a chamber for holding the pills. The chamber can communicate with the open end. The cap has an inside surface for releasably attaching to the open end of the casing to close the casing. The container has a pin that is centrally secured at the inside surface of the cap and is positioned to extend into the chamber of the casing upon attachment of the cap to the casing. Also included is a plunger that is slidably mounted in the chamber of the casing. The container also has an urging means mounted in the casing for urging the plunger toward the open end.

By employing a device of the foregoing type an improved container for pills is achieved. In a preferred embodiment, the casing is sized to allow the loading of a predetermined number of nitroglycerin pills into the chamber of the casing without exposing the pills and without the need to compress the spring. The pills are in place before the cap is connected and the chamber is sized to accept pills only in a flat stacked position, so that they cannot cock. When the cap is removed from the casing the spring will not eject unwanted pills from the open end. Preferably, the casing is externally threaded and the cap is internally threaded so they can be screwed 10 together. A gasket may be mounted at the mouth of the casing to form a watertight seal when the cap is threaded to the casing. An eyelet, shaped to receive a chain or ring, is attached atop the cap to allow the user to wear the container. Preferably, the chamber 15 diameter matches the diameter of a nitroglycerin pill.

BRIEF DESCRIPTION OF THE DRAWINGS

The above description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 1 is an axial-sectional view of a container for pills in accordance with the principles of the present invention;

FIG. 2 is a top view of the cap of the container of FIG. 1;

FIG. 3 is a bottom view of the casing of FIG. 1; and

DETAILED DESCRIPTION OF THE PREFERRED EMBODIMENTS

Figure 4:
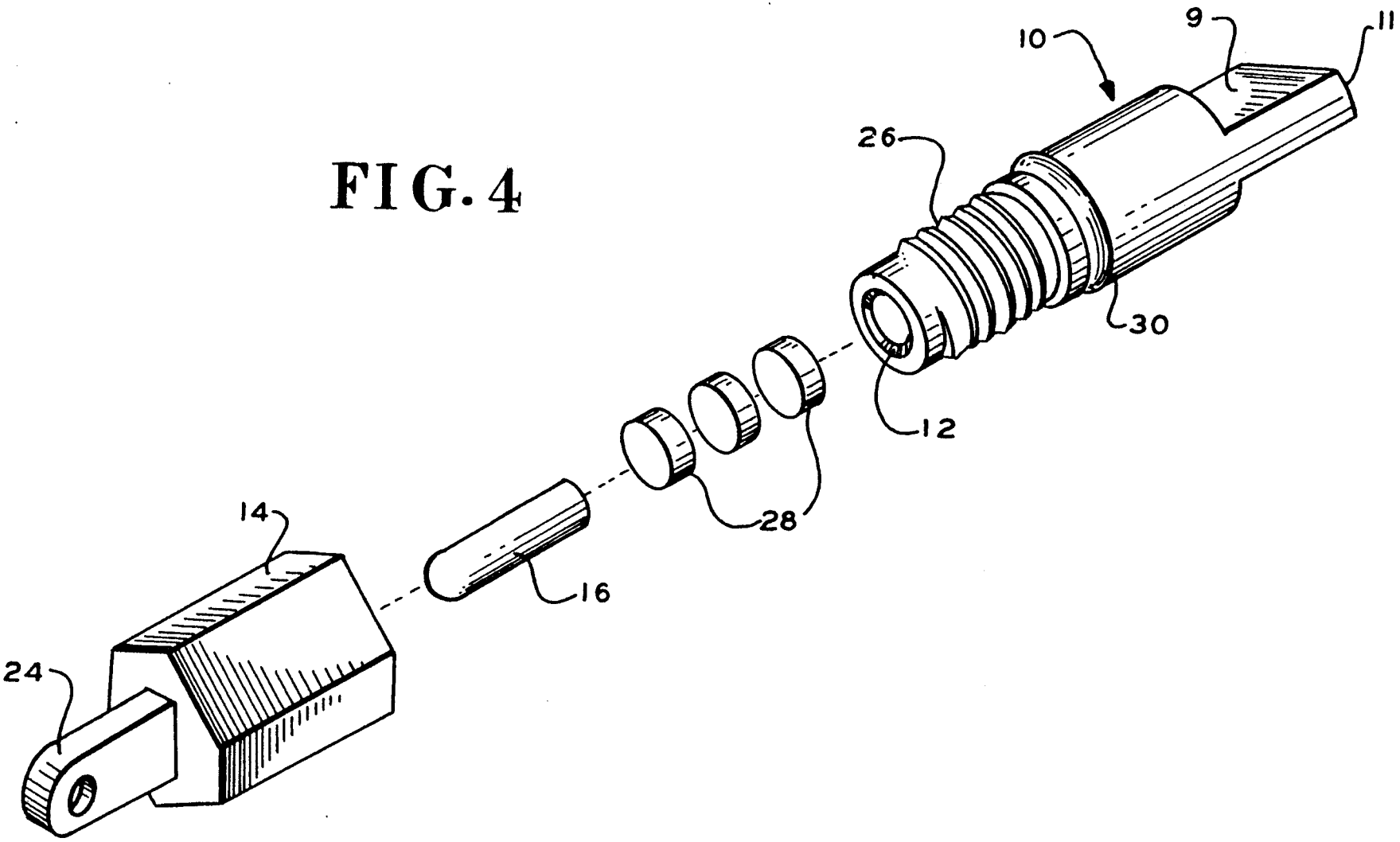
FIG. 4 is an exploded perspective view of the pill container of FIG. 1.

Referring to FIGS. 1–4, a pill container has nitroglycerin pills 28 in casing 10. The container is preferably 2⅛ inches long. Casing 10 is generally shaped as a hollow cylinder with closed end 11, open end 12 and cylindrical chamber 18 for holding and communicating with open end 12. The casing is preferably made of a plastic such as Delrin, which is unlikely to react with the nitroglycerin pills. However, the casing can be made from a variety of different materials, such as glass, metal, ceramic, etc. Casing 10 is generally cylindrical with the section near opening 12 having external threads. The periphery of casing 10 adjacent end 11 has an opposing pair of flats 9 for the easy grasping of the container by the user. Flat sides 9 are preferably 0.5 inches long.

Cap 14 has a cylindrical hollow with internal threads 26 for screwing onto the threads of casing 10 to tightly seal pills 28 in the container. While threads are preferred, other embodiments may employ snap fittings, bayonet couplings, external fasteners, etc. Cap 14 is preferably made of a plastic such as Delrin, however it can be made of other materials such as glass, ceramic or metal. The external shape of cap 14 is a hexagonal prism, although it can have various other shapes such as a cylinder with flats, various polygonal prisms, spherical, etc. Attached atop cap 14 is an eyelet 24 for holding a chain to enable a user to wear the container. Alternately, the eyelet can be kept on a key ring.

Pin 16 is centrally secured at the inside surface of cap 14 by inserting the pin into coaxial bore 13 of cap 14. Preferably, pin 16 is made of a material similar to cap 14. Pin 16 and coaxial bore 13 have roughly equivalent diameters to ensure a snug or float fit. Pin 16 is positioned to extend into chamber 18 of casing 10 when cap 14 is attached to casing 10. Preferably pin 16 is a slender, solid cylinder, although, it can have other shapes as well. In some embodiments the pin will be screwed into or integrally molded in the cap.

Mounted in an annular groove around casing 10 is gasket 30. Gasket 30 ensures that when cap 14 is threadably secured to casing 10 a watertight and preferably, an air tight seal is formed. This allows the container to be worn in the shower and elsewhere without damaging or affecting the potency of nitroglycerin pills 28.

Plunger 20 is slidably mounted in chamber 18 of the casing. Plunger 20 is preferably made of plastic such as Delrin, although, it can be made of other materials such as metal, ceramics, glass, etc. In addition, the plunger is cylindrical and cup-shaped. Compression spring 22 (also referred to as urging means) is mounted between closed end 11 of casing 10 and the hollow of plunger 20. Compression spring 22 allows plunger 20 to secure pills 28 against pin 16.

Pills 28 are preferably nitroglycerin pills that have a standard diameter, although, other types of pills can be used instead. Chamber 18 and outer end 21 of plunger 20 have diameters roughly equivalent to the fixed diameter of the nitroglycerin pills.

To facilitate an understanding of the principles associated with the foregoing apparatus, its operation will now be briefly described. Cap 14 is unscrewed from casing 10 by grasping the flat sides of cap 14 and casing 10. The nitroglycerin pills 28 are placed in open end 12 of casing 10 without the need to compress spring 22. Cap 14 is then screwed onto casing 10. Pin 16, mounted in cap 14, pushes pills 28 against plunger 20. Spring 22 is compressed as pin 16 further enters casing 10. This ensures that pills 28 will be secured between plunger 20 and pin 16. Unwanted pills will not pop out from casing 10 when cap 14 is removed and spring 22 expands since the pills were originally inserted without compressing the spring.

Next, a chain (not shown) may be inserted through eyelet 24. Preferably the chain is worn around the user's neck, however, the eyelet can be directly attached to a key ring or a belt buckle.

Upon noticing the onset of an attack, a sufferer will grasp casing 10 around flat sides 9 with one hand and the hexagonal perimeter of cap 14 with the other hand. Cap 14 is then unscrewed from casing 10. Plunger 20 will move pills 28 toward open end 12 by means of spring 22 as pin 16 moves out of open end 12. However, the spring does not eject pills 28 past open end 12. The casing will then be tilted to dispense one or more pills from open end 12. The sufferer can then take the required dosage to alleviate the attack.

Once the requisite dosage has been taken the sufferer may replenish the pills in the container with pills and screw cap 14 onto casing 10. Pin 16 will again force pills 28 towards plunger 20 thereby compressing spring 22 and holding the pills securely in place. The container can then be replaced around the user's neck.

Obviously, many modifications and variations of the present invention are possible in light of the above teachings. It is therefore to be understood that within the scope of the appended claims, the invention may be practiced otherwise than as specifically described.

I claim:

1. A container for pills comprising:

a casing having a closed end, an open end, and a chamber for holding said pills and communicating with said open end;

a cap having an inside surface for releasably attaching to said open end and closing said casing;

a pin centrally secured at said inside surface of said cap, said pin positioned to extend into said chamber of said casing upon attachment of said cap to said casing;

a plunger slidably mounted in said chamber of said casing; and urging means in said casing for urging said plunger toward said open end to hold said pills in position, against said pin until removal of said cap from said casing so that agitation would not tend to powder said pills.

2. The container of claim 1 wherein said casing and said urging means are sized to hold a predetermined number of said pills in said chamber of said casing without exposing said pills past said open end.

3. The container of claim 2 wherein said casing is externally threaded at said open end.

4. The container of claim 2 wherein said casing has external threads at said open end and at said closed end a pair of opposing flats.

5. The container of claim 4 further comprising: a gasket mounted around said casing for forming a watertight seal between said casing and said cap.

6. The container of claim 5 wherein said cap 2 has a cylindrical cavity, said pin being mounted in 3 said cavity.

7. The container of claim 6 wherein said pills are nitroglycerine pills having a fixed diameter, said chamber having an inside diameter matching said fixed diameter of said nitroglycerine pills.

8. The container of claim 7 wherein said plunger has an outer end, said outer end having a diameter matching said fixed diameter.

9. The container of claim 8 wherein said cap has a plurality of circumferentially spaced, flat sides.

10. The container of claim 9 wherein said cap is externally shaped as a hexagonal prism.

11. The container of claim 10 wherein said urging means comprises a compression spring mounted in said chamber between said closed end of said casing and said plunger for urging said pills toward said open end.

12. The container of claim 11 wherein said plunger is cup-shaped, said spring being mounted inside said plunger.

13. The container of claim 12 further comprising an attachment mounted to said cap for allowing said container to be worn.

14. The container of claim 13 wherein said attachment is an eyelet.

15. A container for nitroglycerin pills comprising:

a casing having a closed end, an open end, and a chamber communicating with said open end for holding said nitroglycerin pills, said casing having external threads at said open end and at said closed end a pair of flat sides;

a plunger slidably mounted in said chamber of said casing;

a cap having an internally threaded hollow for threadably attaching to said open end and closing said casing, said cap having an external eyelet and inside said hollow, a coaxial bore;

a pin centrally secured in said coaxial bore of said cap for extending into said chamber of said casing upon attachment of said cap to said casing;

a compression spring mounted in said chamber against said closed end of said casing for urging said plunger and said pills toward said pin; and a gasket mounted around said casing for forming a watertight seal between said casing and said cap.

* * * * *